US008435066B2

(12) United States Patent
Myong et al.

(10) Patent No.: US 8,435,066 B2
(45) Date of Patent: May 7, 2013

(54) ROTATIONALLY CONFIGURABLE BACKSHELL FOR AN ELECTRICAL CONNECTOR

(75) Inventors: Inho Myong, Newark, CA (US); Keith Thomas Yee, San Jose, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 167 days.

(21) Appl. No.: 12/911,111

(22) Filed: Oct. 25, 2010

(65) Prior Publication Data

US 2012/0100745 A1 Apr. 26, 2012

(51) Int. Cl.
*H01R 13/58* (2006.01)

(52) U.S. Cl.
USPC ..... 439/452

(58) Field of Classification Search ..... 439/452, 439/352, 321, 92, 95, 108, 320, 322–323, 439/315–318, 446, 470–473, 31
See application file for complete search history.

(56) References Cited

U.S. PATENT DOCUMENTS

| | | | | |
|---|---|---|---|---|
| 4,808,123 | A * | 2/1989 | Dee et al. | 439/470 |
| 4,863,396 | A * | 9/1989 | Johnson | 439/470 |
| 5,580,278 | A * | 12/1996 | Fowler et al. | 439/607.23 |
| 6,196,865 | B1 * | 3/2001 | Ruffel et al. | 439/472 |
| 6,419,519 | B1 | 7/2002 | Young | |
| 7,419,402 | B2 * | 9/2008 | Carnahan et al. | 439/470 |
| 7,438,579 | B1 * | 10/2008 | Pellen | 439/312 |
| 2007/0037433 | A1 | 2/2007 | Carnahan | |
| 2009/0111319 | A1 | 4/2009 | Baldwin et al. | |
| 2010/0124837 | A1 | 5/2010 | Gimenes et al. | |

FOREIGN PATENT DOCUMENTS

FR 2864713 A1 7/2005

OTHER PUBLICATIONS

International Search Report for International Application No. PCT/US2011/057503, mailed Jan. 20, 2012.

"319-064 Composite Swing-Arm Backshell with Shield Sock and Self-Locking Rotatable Coupling", Glenair Inc., 2009, pp. A-12-A-13.

* cited by examiner

*Primary Examiner* — Edwin A. Leon

(57) ABSTRACT

A backshell for an electrical assembly is provided. The backshell includes a shield termination body having a connector end and a relief end. The connector end is configured to join to a cable end of an electrical connector. A face of the connector end is oriented at an angle with respect to a face of the relief end. A strain relief is provided having a shield end and a cable clamp end. A face of the shield end is oriented at an angle with respect to a face of the cable clamp end. The shield end is rotatably coupled to the relief end of the shield termination body. The shield end of the strain relief is rotatable with respect to the relief end of the shield termination body so that the face of the cable clamp end of the strain relief is positionable at variable angles with respect to the face of the connector end of the shield termination body.

18 Claims, 11 Drawing Sheets

ROTATIONALLY CONFIGURABLE BACKSHELL FOR AN ELECTRICAL CONNECTOR

BACKGROUND

The subject matter described herein relates generally to a backshell for an electrical connector and, more particularly, to a rotationally configurable backshell for an electrical connector.

Electrical connectors generally include loose cables and/or wire bundles that extend from a cable end of the connectors. The cables are configured to engage an electrical component. However, the cables typically are not secured and may be subject to forces that disengage the cables from the electrical component and/or the electrical connector. The cables may be protected by a backshell. The backshell is secured to the cable end of the connector and includes a strain relief mechanism to secure the cables. The backshell is commonly arranged in one of three orientations with respect to the electrical connector. The backshell may be oriented in-line, i.e. 0 degrees with respect to the connector, or the backshell may be oriented at a 45 degree or 90 degree angle with respect to the connector. These angular configurations accommodate most applications of the electrical connector.

However, most backshells are not interchangeable to accommodate different configurations. Instead, different backshells are often required to be utilized to accommodate each angle. Accordingly, as the application of an electrical connector changes, a new backshell must be coupled to the electrical connector. Some backshells are configured to accommodate different angles. However, these backshells generally include a pair of arms that rotate independently with respect to the electrical connector and the body of the backshell. Accordingly, it is difficult to properly align the arm at the desired angle. Additionally, the arms are retained using multiple screws. Each screw must be manipulated to adjust the angle of the backshell and requires separate operations. As such, these backshells tend to be clumsy and require significant time and work to adjust.

Accordingly, there is a need for an adjustable rotationally configurable backshell that can be adjusted with little effort.

SUMMARY OF THE INVENTION

In one embodiment, a rotationally configurable backshell to be joined to an electrical connector is provided. The rotationally configurable backshell includes a connector body having a connector interface and a shield interface. The connector interface is configured to engage and form an electrical connection with the electrical connector. A shield termination body is provided having a connector end and a relief end. The connector end is joined to the connector interface of the connector body. The connector end is oriented at an angle with respect to the relief end. The shield termination body is configured to shield a cable extending from the electrical connector. A strain relief is provided having a shield end and a cable clamp end. The shield end is oriented at an angle with respect to the cable clamp end. The shield end is rotatably joined to the relief end of the shield termination body. The shield end of the strain relief is rotatable with respect to the relief end of the shield termination body so that the cable clamp end of the strain relief is positionable at variable angles with respect to the connector end of the shield termination body. The cable clamp end of the strain relief is configured to secure the cable extending from the electrical connector.

In another embodiment, a backshell for an electrical assembly is provided. The backshell includes a shield termination body having a connector end and a relief end. The connector end is configured to join to a cable end of an electrical connector. A face of the connector end is oriented at an angle with respect to a face of the relief end. A strain relief is provided having a shield end and a cable clamp end. A face of the shield end is oriented at an angle with respect to a face of the cable clamp end. The shield end is rotatably coupled to the relief end of the shield termination body. The shield end of the strain relief is rotatable with respect to the relief end of the shield termination body so that the face of the cable clamp end of the strain relief is positionable at variable angles with respect to the face of the connector end of the shield termination body.

DETAILED DESCRIPTION OF THE DRAWINGS

The foregoing summary: as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
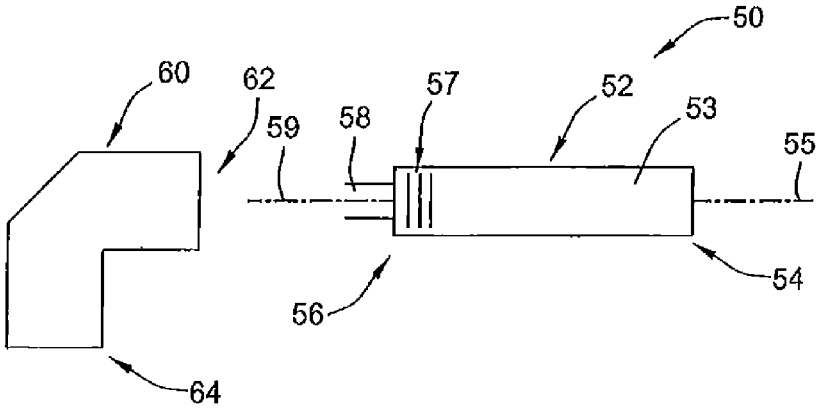
FIG. 1 is an exploded view of an electrical assembly.

FIG. 1 is an exploded view of an electrical assembly 50. The electrical assembly 50 includes an electrical connector 52. The electrical connector 52 may be any suitable connector for use in the aerospace and automotive industries or the like. Alternatively, the electrical connector 52 may be suitable for any electrical application. The electrical connector 52 includes a body 53 with a mating end 54 and a cable end 56. The mating end 54 is configured to couple to a corresponding connector. The cable end 56 includes a cable bundle 58 extending therefrom. Alternatively, multiple cables and/or loose wires may extend from the cable end 56. The cable bundle 58 is configured to join an electrical component (not shown). The electrical connector 52 transmits power and/or data signals from the electrical component to another electrical component coupled to a corresponding connector. Alternatively, the electrical connector 52 may transmit optical signals or any other suitable signal to a corresponding connector. The cable bundle 58 may extend from the electrical connector 52 at an angle to accommodate a designated wire harness path and/or a channel. The cable bundle 58 has a longitudinal axis 59 and the electrical connector 52 has a longitudinal axis 55. The cable bundle 58 may extend from the electrical connector 52 so that the longitudinal axis 59 of the cable bundle 58 is oriented at an angle with respect to the longitudinal axis 55 of the electrical connector 52. The axes 59 and 55 may be oriented at any angle. In one embodiment, the axes 59 and 55 may be oriented at any angle between 0 and 180 degrees.

A backshell 60 is configured to secure to a threaded area 57 of the cable end 56 of the electrical connector 52. Optionally, the backshell 60 may be snapped onto the cable end 56 of the electrical connector 52. The backshell 60 is configured to receive the cable bundle 58. The backshell 60 secures the cable bundle 58 and protects the cable bundle 58 from forces that may be imposed on the cable bundle 58 and/or the electrical connector 52. The backshell 60 also prevents the cable bundle 58 from being disengaged from the electrical connector 52 and/or the corresponding electrical component. The backshell 60 may also provide electromagnetic shielding for the cable bundle 58. The backshell 60 includes a connector end 62 and a cable clamp end 64. The cable bundle 58 is inserted into the connector end 62. The connector end 62 may include a cable shield termination body 114 (shown in FIG. 2) to terminate a shield of the cable bundle 58. The cable shield termination body may include a corrosion-resisting steel termination band or the like. The cable bundle 58 extends through the backshell 60 and is secured at the cable clamp end 64. The cable clamp end 64 may include a cable tie, a saddle clamp, a cable bundling string, and/or a heat-recoverable, e.g. heat-shrinkable boot, e.g. a heat-shrinkable molded boot. Alternatively, the cable clamp end 64 may be fabricated from radially expanded elastomeric material in a similar shape as described herein as heat-recoverable component.

Figure 2:
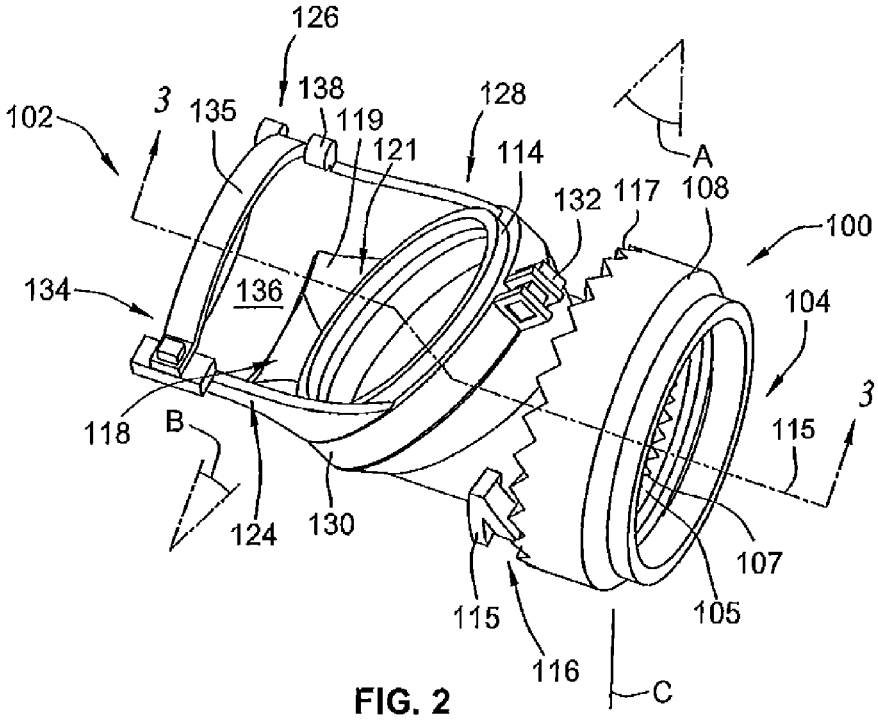
FIG. 2 is a perspective view of a backshell formed in accordance with an embodiment and that may be used with the electrical assembly shown in FIG. 1.
Figure 3:
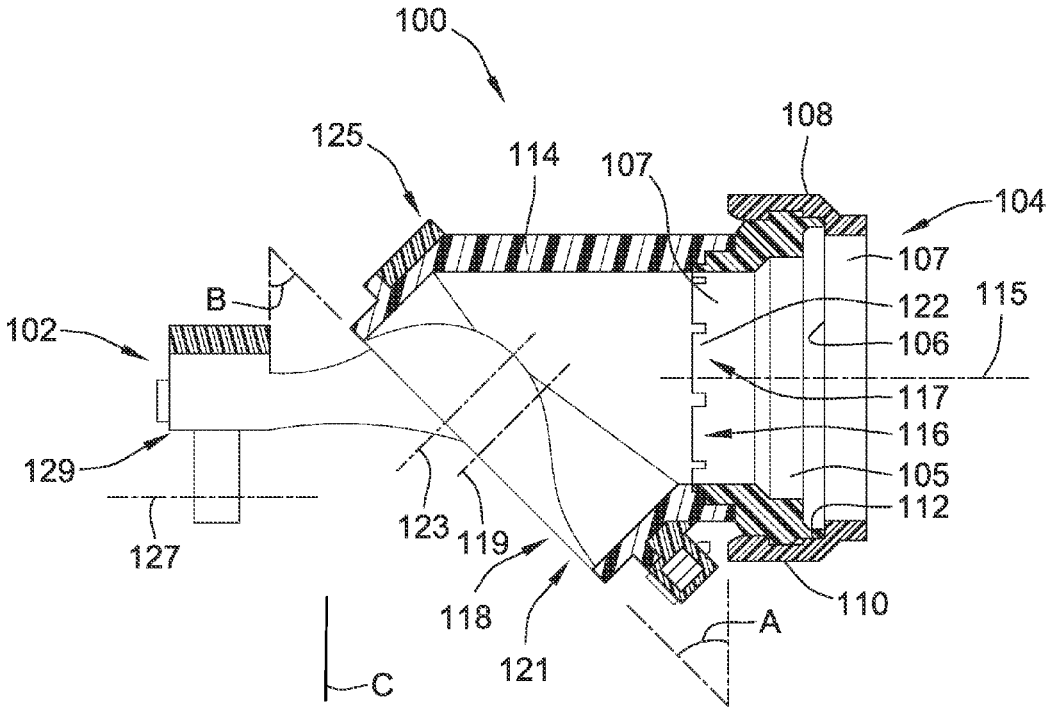
FIG. 3 is a cross-sectional view of the backshell shown in FIG. 2 taken along line 3-3.

FIG. 2 is a perspective view of a backshell 100 formed in accordance with an embodiment that may be used with the electrical assembly 50 in place of the backshell 60. FIG. 3 is a cross-sectional view of the backshell 100 taken along line 3-3. The backshell 100 includes a strain relief end 102 and a connector end 104. The connector end 104 includes a connector body 105 having a connector interface 106 and a shield interface 107 (shown in FIG. 3). A coupling nut 108 is joined to the connector interface 106. The coupling nut 108 is configured to couple to the electrical connector 52. For example, the coupling nut 108 may engage a rear accessory thread 57 of the electrical connector 52. The connector body 105 provides an electrical connection to the electrical connector 52 to protect the backshell 100 from electromagnetic interference generated by the cable bundle 58. The connector body 105 includes teeth 117 that are configured to engage the electrical connector 52 to prevent the backshell 100 from rotating with respect to the electrical connector 52. The coupling nut 108 engages the connector interface 106 to secure the connector body 105 to the electrical connector 52. Referring to FIG. 3, an outer surface 110 of the connector body 105 engages an inner surface 112 of the coupling nut 108 so that the connector body 105 is positioned within the coupling nut 108.

Referring back to FIG. 2, a shield termination body 114 is joined to the shield interface 107 of the connector body 105. The shield termination body 114 is configured to provide electromagnetic shielding to achieve a predetermined electromagnetic compatibility. For example, the shield termination body 114 may be configured to optimize electromagnetic compatibility of the backshell 100. The shield termination body 114 may include a shield termination device, for example, a corrosion resistant shield termination band or the like. The shield termination body 114 includes a connector end 116 and a relief end 118. The connector end 116 has a longitudinal axis 115 and a face 117 that defines a plane. The relief end 118 has a longitudinal axis 119 and a face 121 that defines a plane. The face 117 of the connector end 116 is oriented at an angle A with respect to the face 121 of the relief end 118. In an example embodiment, the face 117 is oriented approximately 45 degrees with respect to the face 121. Alternatively, the face 117 may be oriented at any angle with respect to the face 121. The longitudinal axes 115 and 119 are also oriented at an angle with respect to one another. In one embodiment, the longitudinal axes 115 and 119 may be oriented at an angle between 0 and 180 degrees.

The shield interface 107 of the connector body 105 includes tabs 122 (illustrated in FIG. 3). The shield interface 107 is inserted into the connector end 116 of the shield termination body 114 so that the tabs 122 secure the shield termination body 114 to the connector body 105. The shield termination body 114 also includes a spring 115. The spring 115 is configured to engage teeth 117 on the coupling nut 108. The spring 115 engages the teeth 117 to limit rotation of the coupling nut 108 with respect to the shield termination body 114. The spring 115 allows the coupling nut 108 to rotate both clockwise and counter-clockwise so that the nut can be secured to, and disengaged from, the shield termination body 114. Alternatively, the spring 115 may only allow the coupling nut 108 to rotate in a single direction to secure the coupling nut 108 to the shield termination body 114. In such an embodiment, the spring 115 must be disengaged from the teeth 117 to disengage the coupling nut 108 from the shield termination body 114.

Figure 4:
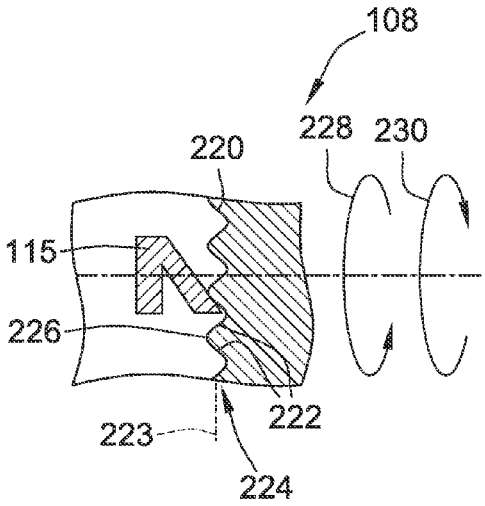
FIG. 4 is an expanded view of the coupling nut of the embodiment shown in FIG. 2.

FIG. 4 illustrates an expanded view of a portion of the coupling nut 108. The coupling nut 108 has teeth 220 that enable the coupling nut 108 to rotate in two directions 228 and 230. Each tooth 220 is formed by surfaces 222 that extend outward from an end 224 of the coupling nut 108 and join at a peak 226: The surfaces 222 extend at a non-orthogonal angle with respect to a plane 223 formed by the end 224 of the coupling nut 108. The spring 115 is configured to rest within a tooth 220 to retain the coupling nut 108 on the shield termination body 114. The spring 115 can be disengaged from the tooth 220 by rotating the coupling nut 108 in either direction 228 or 230. When the coupling nut 108 is rotated, the spring 115 slides along the surface 222 to ratchet along the teeth 220 until the coupling nut 108 is in a desired position.

Figure 5:
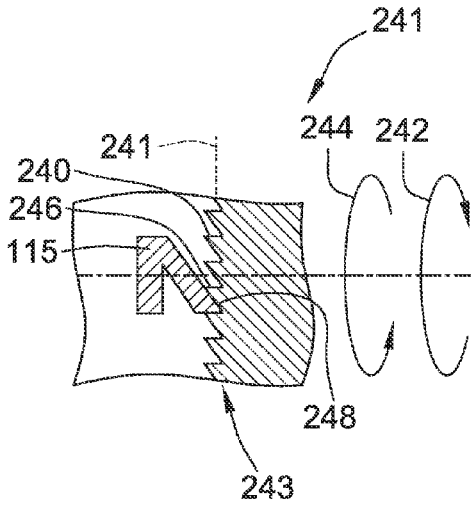
FIG. 5 is an expanded view of an alternative coupling nut formed in accordance with an embodiment and that may be used with the backshell shown in FIG. 2.

FIG. 5 illustrates an alternative coupling nut 241 formed in accordance with an embodiment and that may be used with the backshell 100. The coupling nut 241 has teeth 240 that enable the coupling nut 241 to rotate in a single direction 242. The teeth 240 lock the coupling nut 241 in position and prevent rotation of the coupling nut 241 in the direction 244. Each tooth 240 is formed from a pair of surfaces 246 and 248. The surface 246 extends at a 90 degree angle with respect to a plane 241 formed by an end 243 of the coupling nut 241. Alternatively, the surface 246 may extend at any angle less than 90 degrees that locks the spring 115 within the tooth 240. The surface 248 extends from the end 243 of the coupling nut 241 at an angle that is greater than 90 degrees. Alternatively, the horizontal side of the spring 115 and coupling nut 241 can be increased between horizontal to 45 degrees as in FIG. 4 to achieve a desirable disengaging force.

The surface 248 enables the coupling nut 241 to rotate in the direction 242. When the coupling nut 241 is rotated in the direction 242, the spring 115 slides along the surface 248 and ratchets along the teeth 240 until the coupling nut 241 is in a desired position. The spring 115 locks within the teeth 240 so that the spring engages the surface 246. The spring 115 is prevented from sliding along the surface 246 and prevents the coupling nut 241 from being rotated in the direction 244. To rotate the coupling nut 241 in the direction 244, the spring 115 must first be manually disengaged from the teeth 240 of the coupling nut 241.

Referring back to FIG. 2, a strain relief 124 is joined to the relief end 118 of the shield termination body 114. The strain relief 124 includes a cable clamp end 126 and a shield end 128. The shield end 128 is joined to the relief end 118 of the shield termination body 114. The shield end 128 includes a band 130 that wraps around the relief end 118 of the shield termination body 114. The band 130 is secured to the shield termination body 114 with a locking pin 132. In an example embodiment, the locking pin 132 does not require tools to be secured to and/or removed from the band 130. The locking pin 132 enables the band 130 to be disengaged from the shield termination body 114 so that the strain relief 124 can rotate with respect to the shield termination body 114.

The cable clamp end 126 of the strain relief 124 includes a cable clamp 134. In the illustrated embodiment, the cable clamp 134 includes a saddle clamp 135. In alternative embodiments, the cable clamp 134 may include a heat-recoverable component, e.g. a heat-shrinkable molded boot. The cable clamp 134 includes a cable tie-down bar 136. The cable tie-down bar 136 is configured for tying down the cable bundle 58 with an attachment mechanism, for example, a cable tie and/or a cable bundling string. The saddle clamp 135 rotates about a cable clamp anchor 138 so that the cable bundle 58 is positionable between the saddle clamp 135 and the cable tie down bar 136.

Figure 6:
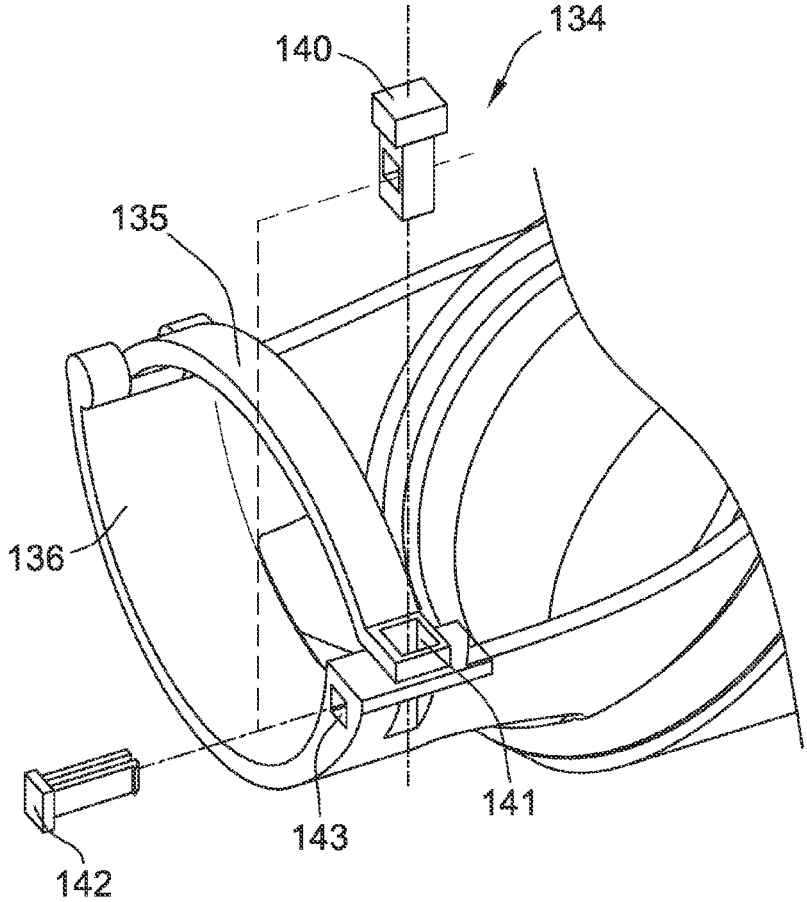
FIG. 6 is an expanded view of the cable clamp of the embodiment shown in FIG. 2.

FIG. 6 illustrates the cable clamp 134. The saddle clamp 135 is secured to the cable tie-down bar 136 with a tool-less locking pins 140 and 142. The tool-less locking pin 140 is inserted through aperture 141 in the cable clamp 134 and the cable tie-down bar 136 to secure the cable clamp 134 to the cable tie-down bar 136. The tool-less locking pin 142 is received in an aperture 143 and engage the tool-less locking pin 140 to secure the tool-less locking pin 140 to the cable tie-down bar 136.

Referring back to FIG. 2, the cable clamp end 126 of the strain relief 124 includes a longitudinal axis 123 and a face 125 that defines a plane. The shield end 128 of the strain relief 124 includes a longitudinal axis 127 and a face 129 that defines a plane. The face 125 of the cable clamp end 126 is oriented at an angle B with respect to the face 129 of the shield end 128. In the illustrated embodiment, the angle B is approximately 45 degrees. Alternatively, the angle B may be any angle. Optionally, the longitudinal axes 123 and 127 may be oriented at an angle. The angles A and B are configured to position the face 129 of the cable clamp end 126 of the strain relief 124 at an angle C with respect to the face 117 of the connector end 116 of the shield termination body 114. The angle C may be any angle. In one embodiment, the angle C is any angle between 0 and 180 degrees. The strain relief 124 is configured to rotate about the shield termination body 114 to position the face 117 of the shield termination body 114 at the angle C with respect to the face 129 of the strain relief 124. FIGS. 2 and 3 show the faces 117 and 129 in parallel at an angle C of 0 degrees. Optionally, the strain relief 124 may be rotated about the shield termination body 114 to adjust an angle between the longitudinal axis 115 of the shield termination body 114 and the longitudinal axis 127 of the strain relief 124.

Figure 7:
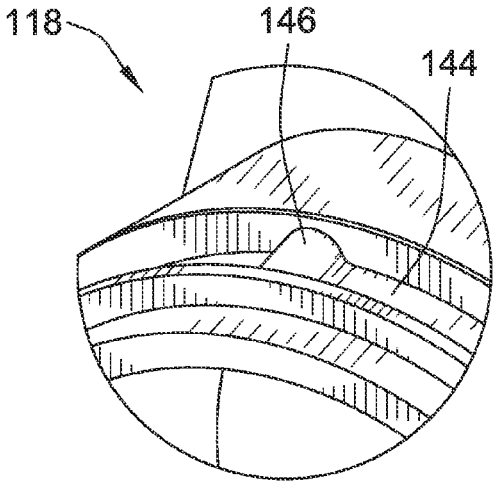
FIG. 7 is an expanded view of a portion of the shield termination body of the embodiment shown in FIG. 2.
Figure 8:
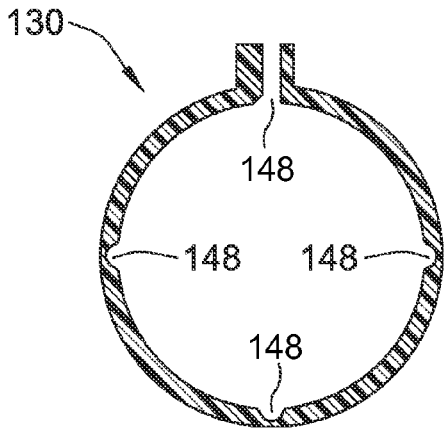
FIG. 8 is a front view of the band of the embodiment shown in FIG. 2.

FIG. 7 illustrates an expanded view of a portion of the relief end 118 of the shield termination body 114. FIG. 8 illustrates a front view of the band 130 of the strain relief 124. The relief end 118 of the shield termination body 114 includes a groove 144 (illustrated in FIG. 7) that extends around a circumference of the relief end 118. The band 130 is configured to position with in the groove 144 so that the band 130 rotates within the groove 144. The strain relief 124 rotates about the shield termination body 114 so that the face 129 of the cable clamp end 126 is positionable at various angles C with respect to the face 117 of the connector end 116 of the shield termination body 114. In one embodiment, the face 129 of the strain relief 124 is configured to position a 0, 45, and 90 degrees with, respect to the face 117 of the shield termination body 114. Optionally, the faces 117 and 129 may be oriented at any angle C.

In one embodiment, the groove 144 includes protrusions 146 (illustrated in FIG. 7). Protrusions 146 are positioned at 180 degree increments around the groove 144. Alternatively, the groove 144 may include four protrusions 146 positioned at 90 degree increments around the groove 144. In another embodiment, the groove 144 may include any number of protrusions 146. The band 130 includes corresponding notches 148 (illustrated in FIG. 8). The notches 148 are positioned at 90 degree increments around the band 130. Alternatively, the band 130 may include any number of notches 148 that corresponds to the number of protrusions 146. The notches 148 are configured to receive the protrusions 146 so that the band 130 locks into a position with respect to the groove 144. In one embodiment, the notches 148 and protrusions 146 are oriented so that the strain relief 124 locks into positions having the face 129 of the strain relief 124 oriented at 0, 45, and 90 degrees with respect to the face 117 of the shield termination body 114. Alternatively, the backshell 100 may not include the protrusions 146 and notches 148. In such an embodiment, the band 130 may rotate freely with groove 144 so that the face 129 of the strain relief 124 can be oriented at any angle C with respect to the face 117 of the shield termination body 114. Alternatively, strain-relief 124 may be fitted through one or more openings and matching tabs on body 114 to assemble the body 114 and strain-relief 124 together during installation. Protrusion or protrusions 144 located around the groove 362 may be placed at one or more locations to stop the rotation of the strain-relief 124 at a desired angle—00, 45 or 90 degree.

Figure 9B:
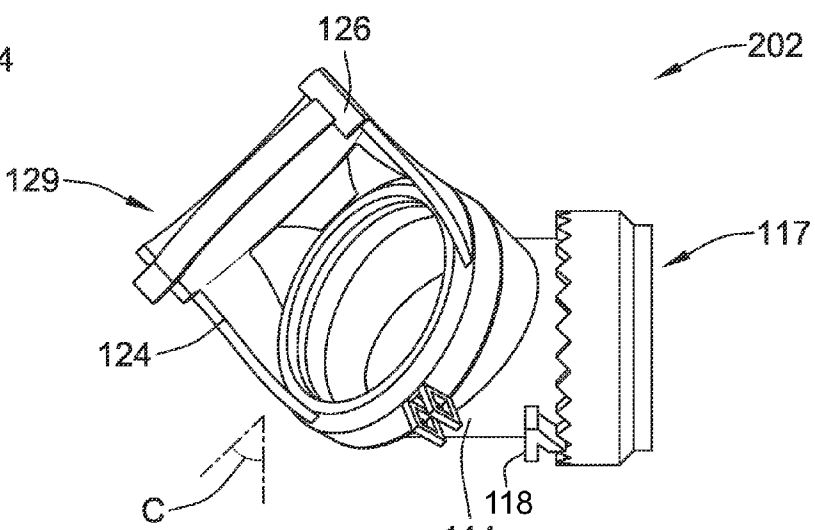
FIG. 9 illustrates the backshell of the embodiment shown in FIG. 2 in various positions.
Figure 9A:
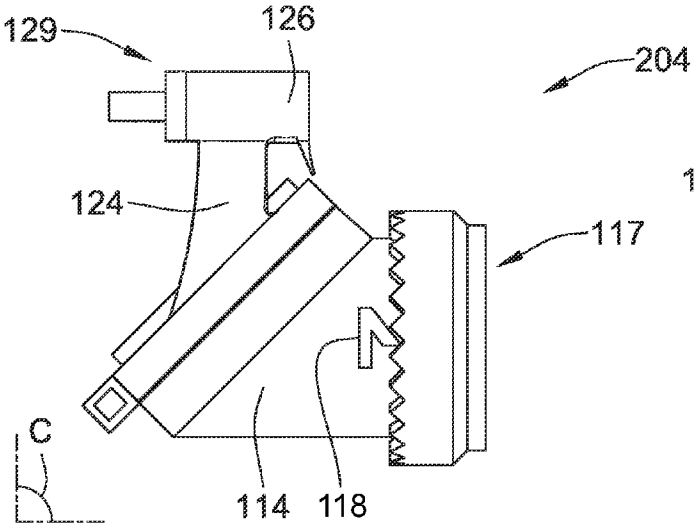
Figure 9C:
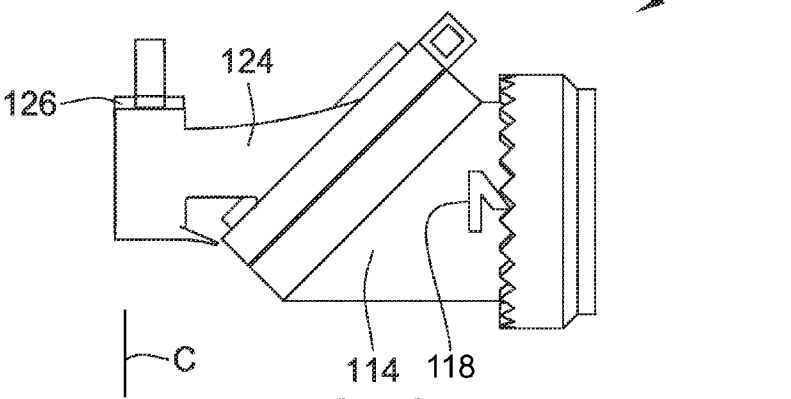

FIG. 9 illustrates the backshell 100 in various positions. At position 200, the faces 117 and 129 of the backshell 100 are oriented at an angle C having 0 degrees. At position 202, the faces 117 and 129 of the backshell 100 are positioned at an angle C having 45 degrees. At position 204, the faces 117 and 129 of the backshell 100 are oriented at an angle C having 90 degrees. The strain relief 124 of the backshell 100 rotates about the shield termination body 114 to position the backshell 100 in any one of positions 200, 202, and 204. The angle B of the strain relief 124 and the angle A of the shield termination body 114 create the angle C between the face 117 of the shield termination body 114 and the face 129 of the strain relief 124.

The angle C accommodates different applications of the backshell 100. The backshell 100 is adaptable for use at any angle 0, 45, and 90 degrees. In one embodiment, the protrusions 146 and the notches 148 lock the backshell into position at any one of 0, 45, and 90 degrees. Optionally, the strain relief 124 may rotate freely about the shield termination body 114 to position the faces 117 and 129 of the backshell 100 at any angle. The locking pin 132 enables the band 130 of the strain relief 124 to be disengaged from the groove 144 of the shield termination body 114. In one embodiment, the locking pin 132 is operated without tools to disengage the band 130 from the groove 144. Disengaging the band 130 from the groove 144 allows the strain relief 124 to rotate with respect to the shield termination body 114. The strain relief 124 is rotated to position the backshell 100 in any one of positions 200, 202, and 204. In another embodiment, the strain relief 124 may be rotated to position the faces 117 and 129 of the backshell 100 at any angle.

Figure 10:
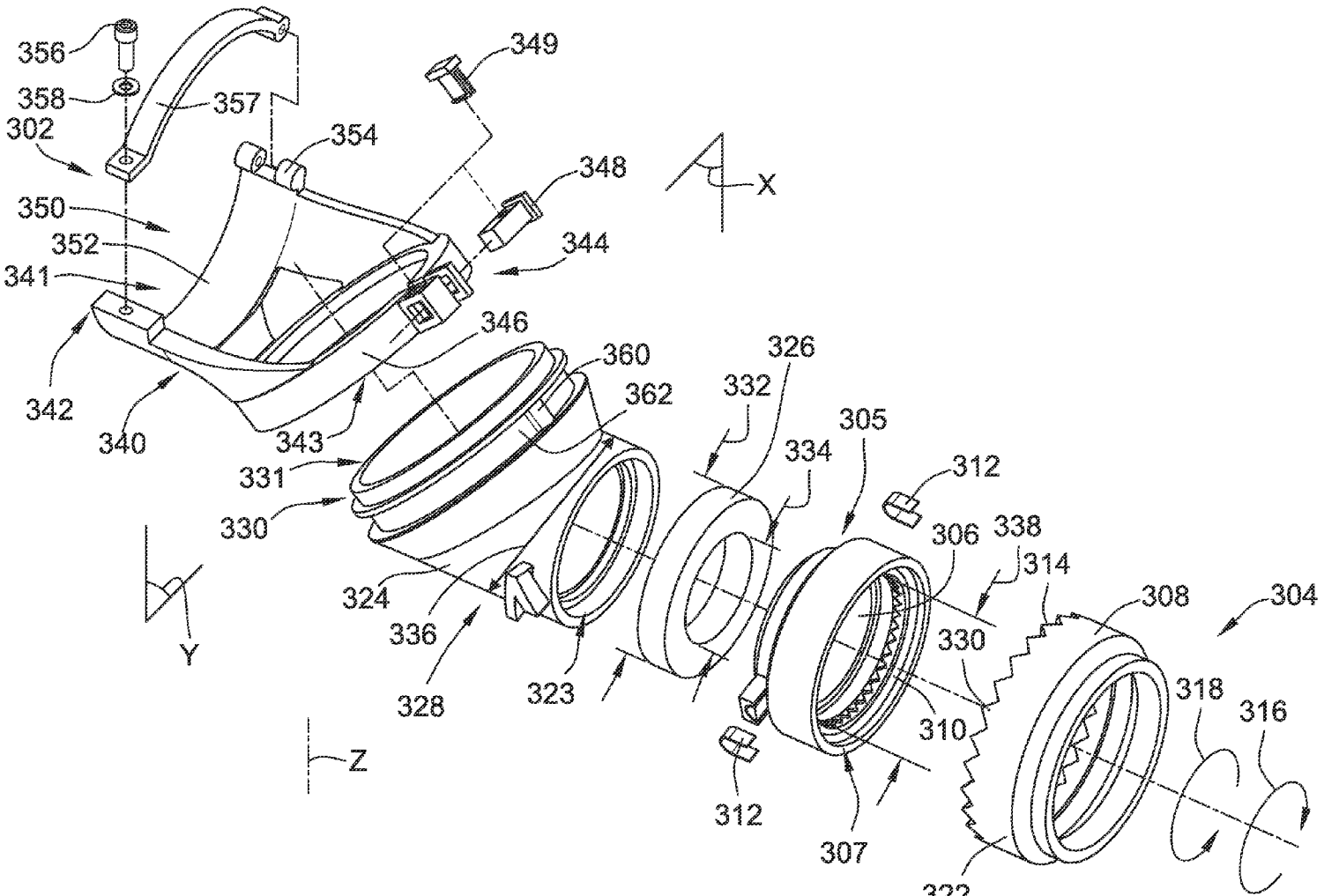
FIG. 10 is an exploded view of a backshell formed in accordance with an embodiment and that may be used with the electrical assembly shown in FIG. 1.

FIG. 10 illustrates a backshell 300 formed in accordance with an embodiment and that may be used with the electrical assembly 50. The backshell 300 has a strain relief end 302 and a connector end 304. The connector end 304 includes a backshell body 306 and a coupling nut 308. The backshell body 306 includes a connector interface 305 and a shield interface 307. The coupling nut 308 is configured to be joined to a rear accessory thread 57 of the electrical connector 52 to couple the backshell 300 and the electrical connector 52. The backshell body 306 joins a body of the electrical connector 52 to protect the backshell 300 from electromagnetic interference generated by the cable bundle 58. The backshell body 306 may also include teeth 310 to limit the backshell 300 from rotating with respect to the electrical connector 52. The coupling nut 308 screws onto the connector interface 305 of the backshell body 306 to join the backshell body 306 to the electrical connector 52.

The backshell body 306 includes at least one spring 312 that is configured to engage teeth 314 that are provided on the coupling nut 308. The spring 312 engages the teeth 314 to limit a rotation of the coupling nut 308 with respect to the backshell body 306. In the illustrated embodiment, the teeth 314 enable the coupling nut 308 to rotate in a two directions 316 and 318. Each tooth 314 includes surfaces 320 that extend at an angle greater than 90 degrees from an end 322 of the coupling nut 308. The spring 312 is configured to rest within a tooth 314 to retain the coupling nut 308 on the backshell body 306. When the coupling nut 308 is rotated in either direction 316 or 318, the spring 312 ratchets within the teeth 314 until the coupling nut 308 is in a desired position. One of the directions 316, 318 tightens the coupling nut 308 onto the backshell body 306. The other direction 316, 318 disengages the coupling nut 308 from the backshell body 306. In an alternative embodiment, the teeth 314 of the coupling nut 308 may be configured to allow rotation of the coupling nut 308 in only one of the directions 316, 318. In such an embodiment, the spring 312 must be manually disengaged from the teeth 314 to disengage the coupling nut 308 from the backshell body 306.

A shield termination body 324 is joined to the backshell body 306 via a reducer 326. The shield termination body 324 provides electromagnetic shielding to achieve a pre-determined electromagnetic capability of the backshell 300. The shield termination body 324 may include a shield termination device, for example, a corrosion resistant shield termination band or the like. The shield termination body 324 includes a connector end 328 and a relief end 330. The reducer 326 is configured to be positioned on the connector end 328 of the shield termination body 324. The reducer 326 includes an outer diameter 332 and an inner diameter 334. The inner diameter 334 of the reducer 326 is sized to correspond to an outer diameter 336 of the connector end 328 of the shield termination body 324. The outer diameter 332 of the reducer 326 is sized to correspond to an inner diameter 338 of the shield interface 307 of the backshell body 306.

The inner diameter 334 and the outer diameter 332 of the reducer 326 may be sized for any sized shield termination body 324 and backshell body 306. The reducer 326 enables shield termination bodies 324 and connector interfaces 306 having differing sizes to be joined without manipulating the shield termination body 324 and/or the backshell body 306. The reducer also eliminates a need to replace the shield termination body 324 and/or the backshell body 306 if the shield termination body 324 and the backshell body 306 do not have corresponding sizes. The reducer 326 can be sized and shaped for any sized and/or shaped shield termination body 324 and backshell body 306.

The connector end 328 of the shield termination body 324 includes a face 323 that is oriented at an angle X with respect to a face 331 of the relief end 330 of the shield termination body 324. In an example embodiment, a plane defined by the face 323 is oriented 45 degrees with respect to a plane defined by the face 331. Alternatively, the face 323 may be oriented at any angle with respect to the face 331.

A strain relief 340 is joined to the relief end 330 of the shield termination body 324. The strain relief 340 includes a cable clamp end 342 and a shield end 344. The shield end 344 is joined to the relief end 330 of the shield termination body 324. The shield end 344 includes a band 346 that wraps around the relief end 330 of the shield termination body 324. The band 346 is secured to the shield termination body 324 with a pair of locking pins 348, 349. In an example embodiment, the locking pins 348, 349 do not require tools to be secured to and/or removed from the band 346. The locking pins 348, 349 enable the band 346 to be disengaged from the shield termination body 324 so that the strain relief 340 can rotate with respect to the shield termination body 324.

The cable clamp end 342 of the strain relief 340 includes a cable clamp 350. In the illustrated embodiment, the cable clamp 350 includes a saddle clamp 351. The cable clamp 350 includes a cable tie down bar 352 for tying down the cable bundle 58 with an attachment mechanism. The cable clamp 350 rotates about a cable clamp anchor 354 so that the cable bundle 58 is positionable between the cable clamp 350 and the cable tie down bar 352. The cable clamp 350 is secured to the cable tie down bar 352 with a screw 356 and a washer 358. Alternatively, the cable clamp 350 may be secured with toolless locking pins, a latch, a snap, or the like.

The cable clamp end 342 of the strain relief 340 includes a face 341 that is oriented at an angle Y with respect to a face 343 of the shield end 344 of the strain relief 340. In the illustrated embodiment, the angle Y is approximately 45 degrees. Alternatively, the angle Y may be any angle. The angles Y and X are configured to position a plane defined by the face 341 of the strain relief 340 at an angle Z with respect to a plane defined by the face 323 of the shield termination body 324. The angle Z may be any angle. The strain relief 340 is configured to slidably rotate about the shield termination body 324 to position the face 341 of the strain relief 340 at the angle Z with respect to the face 323 of the shield termination body 324.

The relief end 330 of the shield termination body 324 includes a groove 360 that extends around a circumference of the relief end 330. The band 346 is configured to position with in the groove 360 so that the band 346 slidably rotates within the groove 360. The strain relief 340 rotates about the shield termination body 324 so that the cable clamp end 342 is positionable at various angles Z with respect to the connector end 328 of the shield termination body 324. In one embodiment, the face 341 of the cable clamp end 342 is configured to position at 0, 45, and 90 degrees with respect to the face 323 of the shield termination body 324. Alternatively, the faces 323 and 341 may be positionable at any angle Z.

The groove 360 includes protrusions 362 and the band 346 includes notches (not shown). The notches are oriented around the band 346 to correspond to the protrusions 362 of the groove 360. The notches are configured to engage the protrusions 362 to secure the strain relief 340 with respect to the shield termination body 324. The notches and the protrusions 362 are oriented so that the strain relief 340 locks into positions having the faces 323 and 341 oriented at 0, 45, and 90 degrees. Alternatively, the backshell 300 may not include the protrusions 362 and notches. In such an embodiment, the band 346 may rotate freely within groove 360 so that the cable clamp end 342 of the faces 323 and 341 can be oriented at any angle Z. The shape conversion flange and groove (on the strain-relief) 363 convert a pair of oval shape openings 364 which is not practically rotatable to each other to rotatable against each other.

The angle Z accommodates different applications of the backshell 300. The backshell 300 is adaptable for use at any angle. In one embodiment, the backshell is adaptable for use in any angle of 0, 45, and 90 degrees. In one embodiment, the protrusions 362 and the notches lock the backshell 300 into position. Optionally, the strain relief 340 may rotate freely about the shield termination body 324 to position the backshell 300 at any angle. The band 346 is releasable from the groove 360 to allow the strain relief 340 to rotate with respect to the shield termination body 324. The strain relief 340 may be rotated to position the strain relief end 302 of backshell 300 at an angle with respect to the connector end 304 of the backshell 300.

Figure 11B:
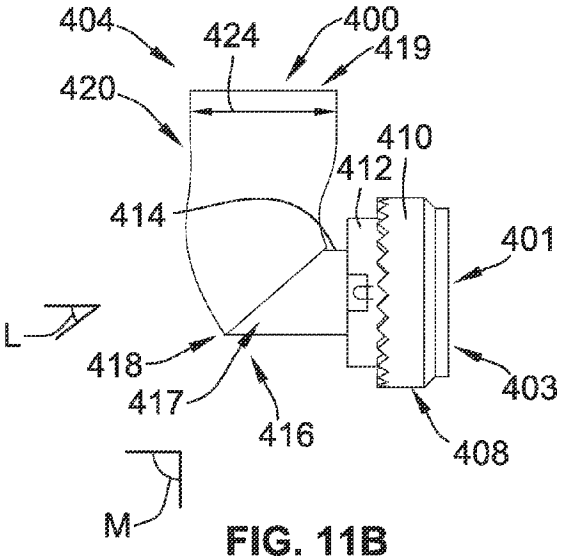
FIG. 11 is a perspective view of a strain relief formed in accordance with an embodiment and that may be used with the backshell shown in FIG. 2 and/or the backshell shown in FIG. 10.
Figure 11A:
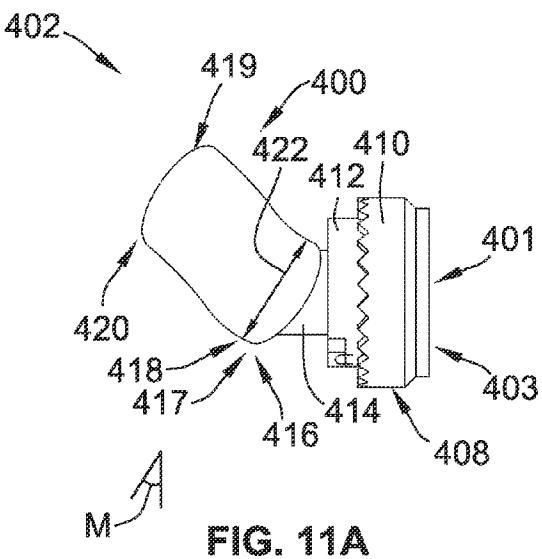
Figure 11C:
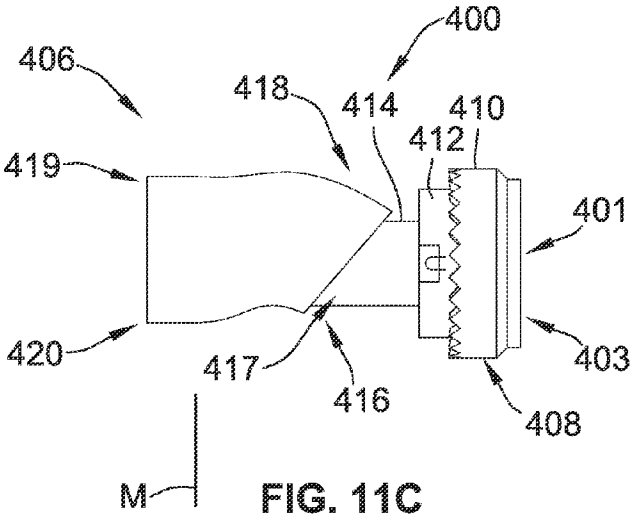

FIG. 11 is perspective view of a strain relief 400 formed in accordance with an embodiment and oriented in positions 402, 404, and 406. The strain relief 400 may be used with the backshell 100 and/or the backshell 300. The strain relief 400 is fabricated from a heat-recoverable component, e.g. heat-shrinkable molded boot or heat-shrinkable tubing. Alternatively, the strain relief may be fabricated from radially expanded elastomeric material in a similar shape as described herein as heat-recoverable component. The boot or tubing may be made of various materials suitable for different environments and service conditions. The strain relief 400 couples to a backshell body 408 having a coupling nut 410, a connector interface 412, and a shield termination body 414. The backshell body 408 includes a mating end 401 for engaging an electrical connector (not shown). The strain relief 400 couples to a strain relief end 416 of the shield termination body 414. The strain relief 400 includes a shield end 418 and a cable end 420. The shield end 418 is joined to the shield termination body 414. The shield end 418 has a diameter 422 that is less than a diameter 424 of the cable end 420. Alternatively, the diameter 422 of the shield end 418 may be similar to the diameter 424 of the cable end 420. The shield end of the boot may have pre-installed or user installed adhesive to promote sealing at the interface. The adhesive materials may vary to accommodate different environmental, chemical, and other conditions.

A face 417 of the shield end 418 is oriented at an angle L with respect to a face 419 of the cable end 420. In the illustrated embodiment, the angle L is approximately 45 degrees. Alternatively, the angle L may be any angle between 0 and 90 degrees. The strain relief 400 rotates about the shield termination body 414 so that the face 419 of the cable end 420 is positioned at an angle M with respect to a face 403 of the mating end 401 of the backshell body 408. Position 402 illustrates the faces 403 and 419 at an angle M of 45 degrees. Position 404 illustrates the faces 403 and 419 at an angle M of 90 degrees. Position 406 illustrates the faces 403 and 419 at an angle M of 0 degrees.

The strain relief 400 is positioned with respect to the backshell body 408 to provide a desired angle M. A cable bundle (not shown) of the electrical connector extends through the strain relief 400. The strain relief 400 may be heated to conform to the strain relief 400 to the cable bundle. Alternatively, the strain relief 400 may be crimped and/or otherwise coupled to the cable bundle. The strain relief 400 prevents the cable bundle from being disengaged from the electrical connector and/or the backshell body 408.

Figure 12B:
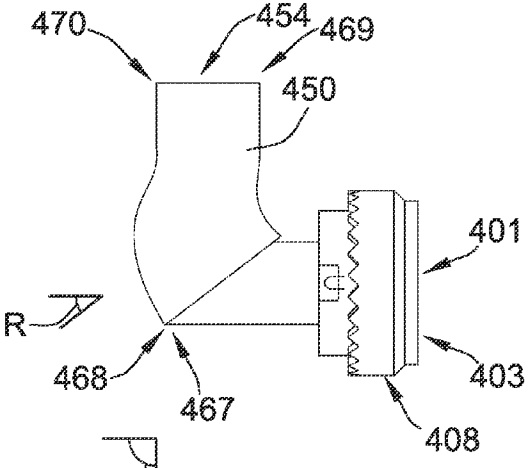
FIG. 12 is a perspective view of a strain relief formed in accordance with an embodiment and that may be used with the backshell shown in FIG. 2 and/or the backshell shown in FIG. 10.
Figure 12A:
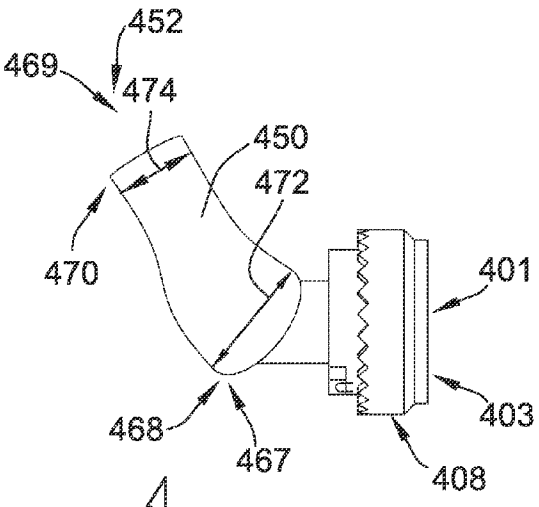
Figure 12C:
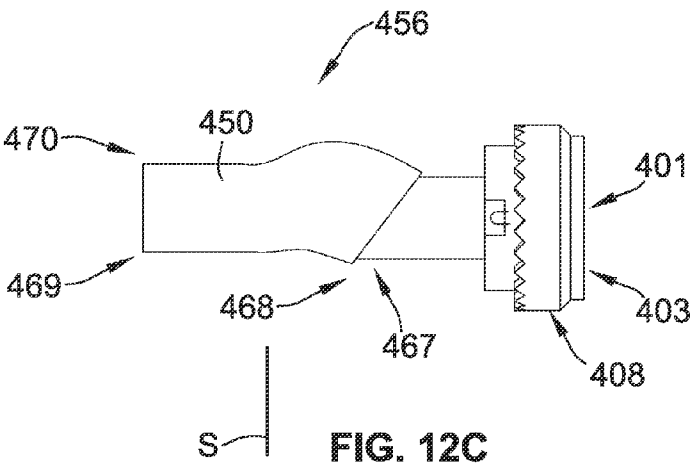

FIG. 12 is perspective view of a strain relief 450 formed in accordance with an embodiment and oriented in positions 452, 454, and 456. The strain relief 450 may be used with the backshell 100 and/or the backshell 300. The strain relief 450 is fabricated from a heat-shrinkable molded part, e.g. in the form of a boot. The strain relief 450 is configured to couple to the backshell body 408. The strain relief 450 includes a shield end 468 and a cable end 470. The shield end 468 has a diameter 472 that is greater than a diameter 474 of the cable end 470. Alternatively, the diameter 472 of the shield end 468 may be similar to the diameter 474 of the cable end 470.

A face 467 of the shield end 468 is oriented at an angle R with respect to a face 469 of the cable end 470. In the illustrated embodiment, the angle R is approximately 45 degrees. Alternatively, the angle R may be any angle. The strain relief 450 rotates about the shield termination body 414 so that the face 469 of the cable end 470 is positioned at an angle S with respect to the face 403 of the mating end 401 of the backshell body 408. Position 452 illustrates the faces 403 and 469 at an angle S of 45 degrees. Position 454 illustrates the faces 403 and 469 at an angle S of 90 degrees. Position 456 illustrates the faces 403 and 469 at an angle S of 0 degrees.

The strain relief 450 is positioned with respect to the backshell body 408 to provide a desired angle S. A cable bundle (not shown) of the electrical connector extends through the strain relief 450. The strain relief 450 may be heated to conform to the strain relief 450 to the cable bundle. Alternatively, the strain relief 450 may be crimped to and/or otherwise secured to the cable bundle. The strain relief 450 prevents the cable bundle from being disengaged from the electrical connector and/or the backshell body 408.

Figure 13:
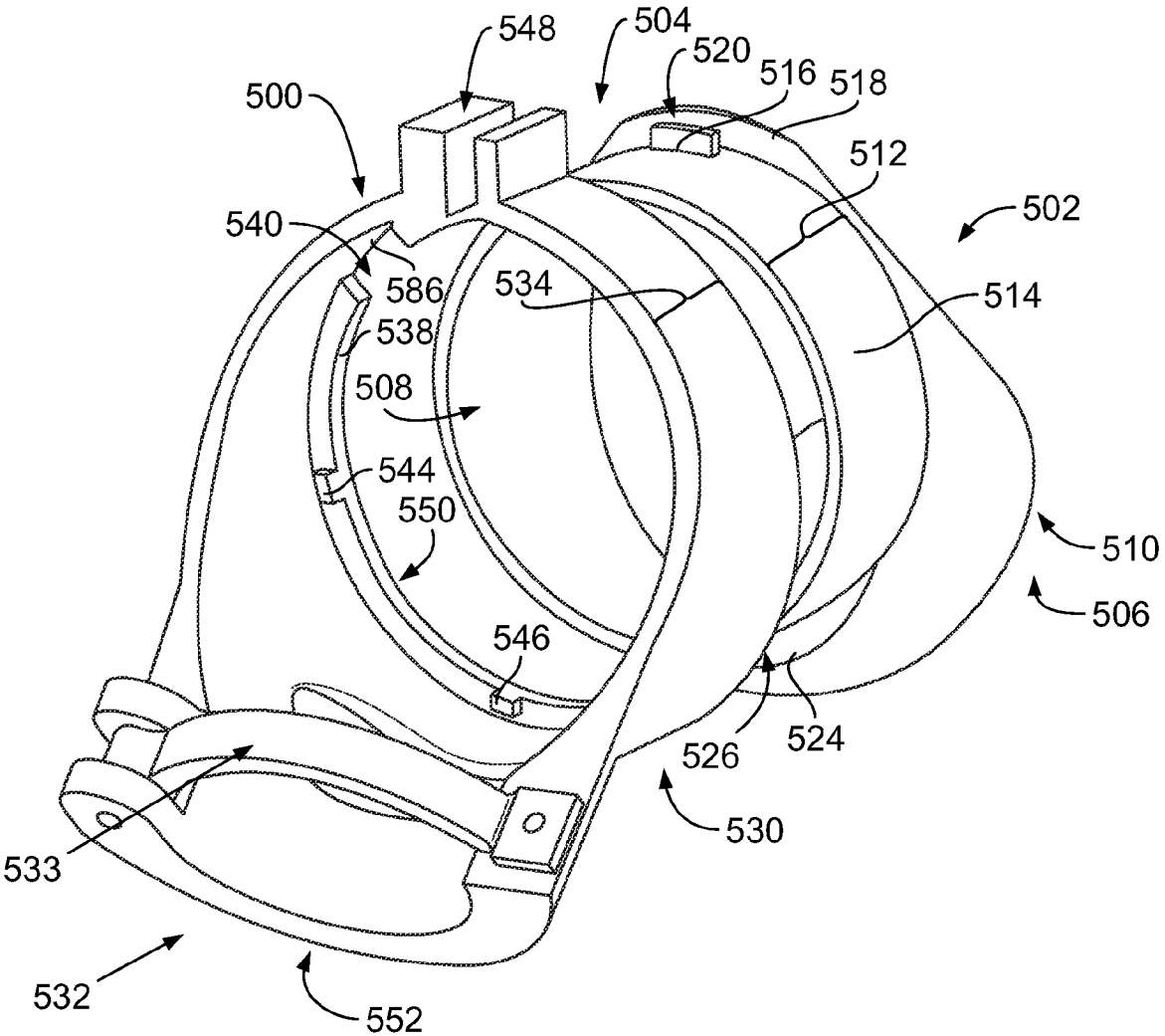
FIG. 13 is a perspective view of a strain relief and shield termination body formed in accordance with an alternative embodiment.

FIG. 13 illustrates a strain relief 500 formed in accordance with an alternative embodiment. The strain relief 500 is configured to be coupled to a shield termination body 502. The shield termination body 502 includes a relief end 504 and a connector end 506. face 508 The relief end 504 includes a face 508 face 510 and the connector end 506 includes a face 510. The face 508 is oriented at an approximately 45 degree angle with respect to the face 510. A mating member 512 is positioned at the relief end 504 of the shield termination body 502. The mating member 512 is generally circular and includes an outer surface 514. A first tab 516 extends radially outward from the surface 514. A first lip 518 is formed in the shield termination body 502 adjacent to the mating member 512. The first lip 518 is aligned with the first tab 516 so that a space 520 is defined between the first lip 518 and the first tab 516. A second tab 522 (shown in FIGS. 14A-15C) extends radially outward from the surface 514. The second tab 522 is positioned approximately 180 degrees from the first tab 516. A second lip 524 is formed in the shield termination body 502 adjacent to the mating member 512. The second lip 524 is aligned with the second tab 522 so that a space 526 is formed between the second lip 524 and the second tab 522.

The strain relief 500 includes a shield end 530 and a cable clamp end 532. In the illustrated embodiment, the cable clamp end 532 includes a saddle clamp 533. The shield end 530 is configured to mate with the relief end 504 of the shield termination body 502. The relief end 504 of the shield termination body 502 is configured to be received within the shield end 530 of the strain relief 504. The shield end 530 of the strain relief 504 includes a mating member 534. The mating member 512 of the shield termination body 502 is sized to be received in the mating member 534 of the strain relief 500.

The mating member 534 of the shield end 530 is generally circular and includes an inner surface 536. A flange 538 extends circumferentially about the inner surface 536. The flange 538 includes a first opening 540 and a second opening 542 (shown in FIGS. 14A and 15A). The first opening 540 is positioned approximately 180 degrees from the second opening 542. The first opening 540 and the second opening 542 are sized to receive either the first tab 516 of the second tab 522 of the shield termination body 502. The first opening 540 is configured to receive one of the first tab 516 or the second tab 522. The second opening 542 is configured to receive the other of the first tab 516 and the second tab 522.

A first protrusion 544 and a second protrusion 546 extend from the flange 538. The first protrusion 544 is positioned proximate to the first opening 540. The second protrusion 546 is positioned proximate to the second opening 542. The first protrusion 544 is positioned between the first opening 540 and the second protrusion 546. The second protrusion 546 is positioned between the second opening 542 and the first protrusion 544.

The mating member 534 includes a lock 548. The lock 548 is configured to receive a locking pin (not shown). The lock 548 is configured to secure the mating member 534 to the mating member 512. The lock 548 prohibits rotation of the mating member 512 within the mating member 534. The locking pin can be removed from the lock 548 to allow rotation of the mating member 512 within the mating member 534.

The shield end 530 of the strain relief 500 includes a face 550. The cable clamp end 532 of the strain relief 500 includes a face 552. The lace 550 is oriented at approximately a 45 degree angle with respect to the face 552.

Figure 14B:
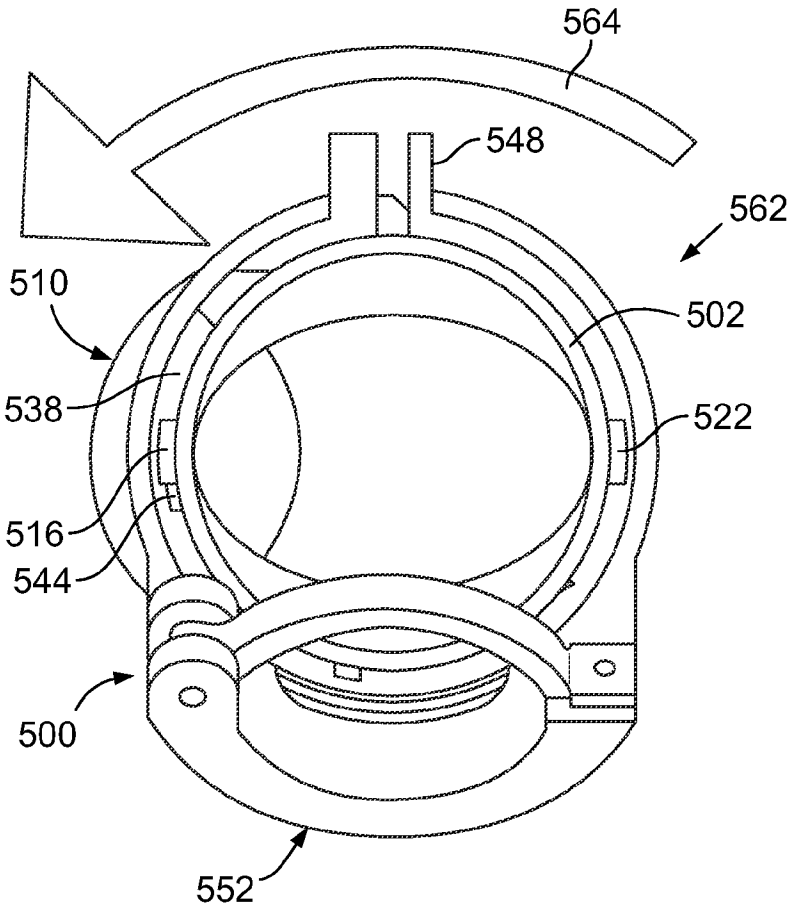
FIG. 14B is a perspective view of the strain relief and shield termination body shown in FIG. 14A and rotated to a 45 degree position.
Figure 14A:
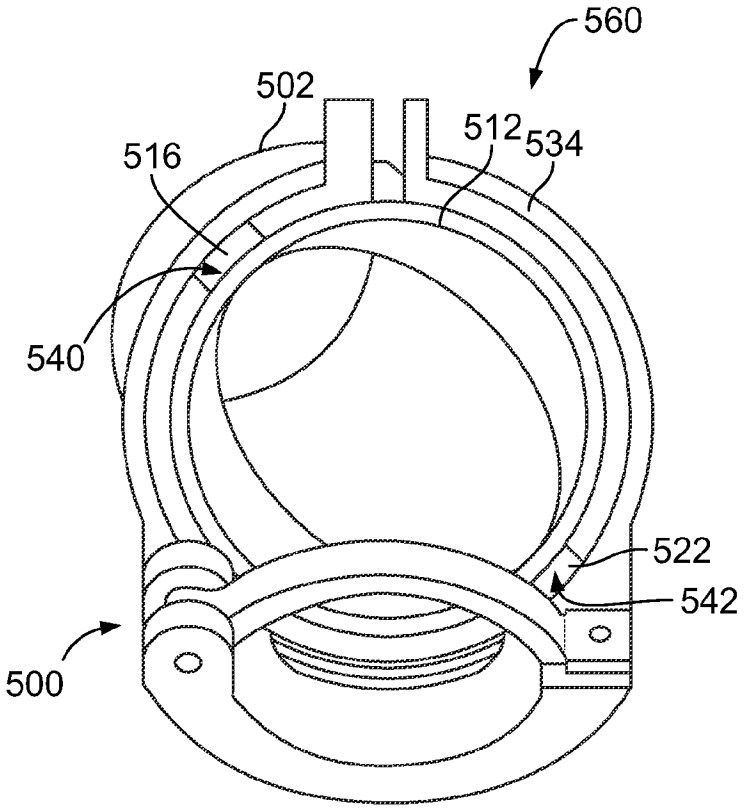
FIG. 14A is a perspective view of the strain relief and shield termination body shown in FIG. 13 and in a first entry position.

FIG. 14A is a perspective view of the shield termination body 502 inserted into the strain relief 500 in a first entry position 560. In the first entry position 560, the mating member 512 of the shield termination body 502 is inserted into the mating member 534 of the strain relief 500. The first tab 516 is inserted through the first opening 540. The second tab 522 is inserted into the second opening 542. The mating member 512 is permitted to rotate within the mating member 534.

FIG. 14B is a perspective view of the strain relief 500 rotated to a first 45 degree position 562. The strain relief 500 is rotated in the direction of arrow 564. The strain relief 500 rotates with respect to the shield termination body 502. The flange 538 rotates within the spaces 520 and 526 of the shield termination body 502. The flange 538 is positioned between the first tab 516 and the first lip 518 to prevent the shield termination body 502 from separating from the strain relief 500. The flange 538 is also positioned between the second tab 522 and the second lip 524 to prevent the shield termination body 502 from separating from the strain relief 500. The flange 538 engages the first tab 516 and the second tab 522 to secure the strain relief 500 to the shield termination body 502.

In the first 45 degree position 562 the first tab 516 is rotated toward the first protrusion 544. The first tab 516 abuts the first protrusion 544. The first protrusion 544 prevents further rotation of the strain relief 500 in the direction of arrow 564. In the first 45 degree position 562 the face 552 formed by the cable clamp end 532 of the strain relief 500 is oriented approximately 45 degrees with respect to the face 510 formed by the connector end 506 of the shield termination body 502. The lock 548 is secured to retain the shield termination body 502 and the strain relief 500 at the 45 degree position.

The strain relief 500 may be rotated to any intermediate position between the first entry position 560 and the first 45 degree position 562 so that the face 552 may be oriented with respect to the face 510 at intermittent angles. The lock 548 is secured to prevent rotation of the strain relief 500 with respect to the shield termination body 502. The lock 548 secures the strain relief 500 to the shield termination body 502 at the intermediate positions between the first entry position 560 and the first 45 degree position 562.

Figure 14C:
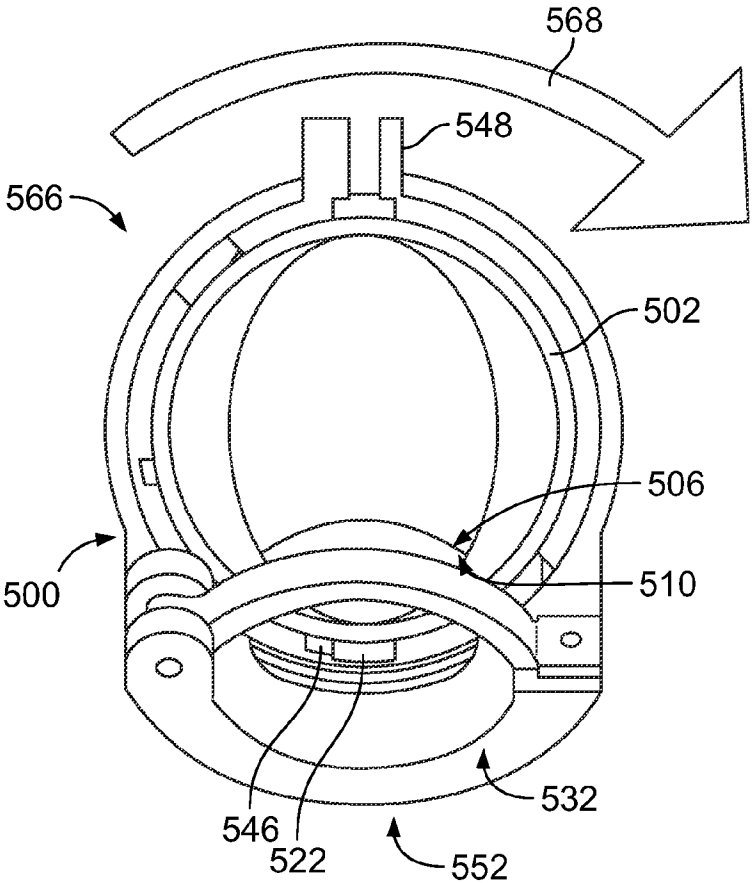
FIG. 14C is a perspective view of the strain relief and shield termination body shown in FIG. 14A and rotated to a 90 degree position.

FIG. 14C is a perspective view of the strain relief 500 rotated to a 90 degree position 566. The strain relief 500 is rotated in the direction of arrow 568. The direction of arrow 568 is opposite to the direction of arrow 564. In the 90 degree position 566 the second tab 522 is rotated toward the second protrusion 546. The second tab 522 abuts the second protrusion 546. The second protrusion 546 prevents further rotation of the strain relief 500 in the direction of arrow 568. In the 90 degree position 566 the face 552 formed by the cable clamp end 532 of the strain relief 500 is oriented approximately 90 degrees with respect to the face 510 formed by the connector end 506 of the shield termination body 502.

The strain relief 500 may be rotated to any intermediate position between the first entry position 560 and the 90 degree position 566 so that the face 552 may be oriented with respect to the face 510 at intermittent angles. The lock 548 is secured to prevent rotation of the strain relief 500 with respect to the shield termination body 502. The lock 548 secures the strain relief 500 to the shield termination body 502 at the intermediate positions between the first entry position 560 and the 90 degree position 566.

Figure 15A:
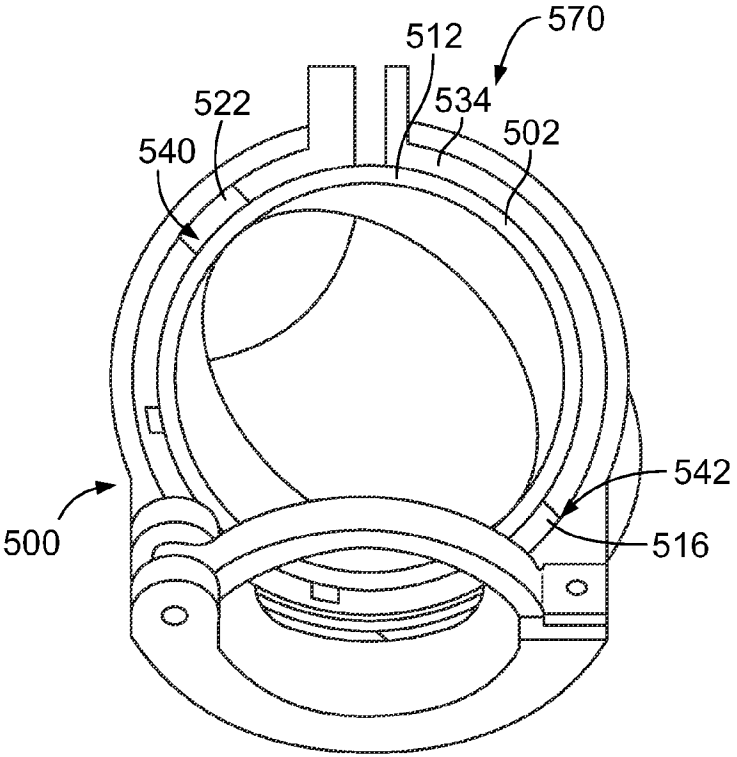
FIG. 15A is a perspective view of the strain relief and shield termination body shown in FIG. 13 and in a second entry position.

FIG. 15A is a perspective view of the strain relief 500 coupled to the shield termination body 502 a second entry position 570. In the second entry position 570, the strain relief 500 is oriented approximately 180 degrees with respect to orientation of the strain relief 500 in the first entry position 560. The first tab 516 is inserted through the second opening 542. The second tab 522 is inserted into the first opening 540. The mating member 512 is permitted to rotate within the mating member 534.

Figure 15C:
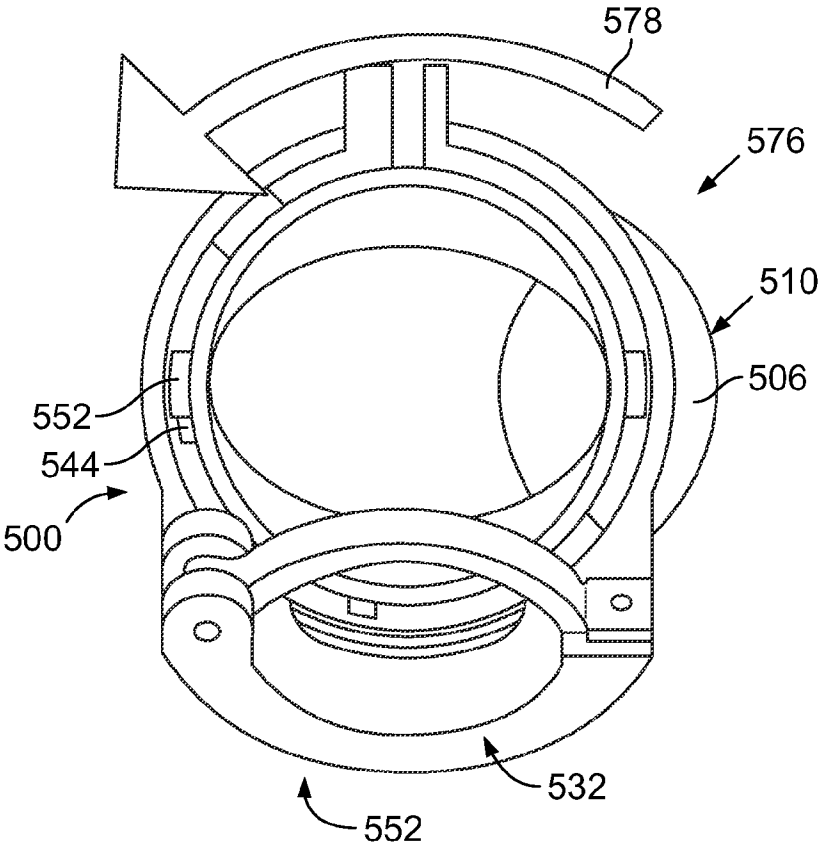
FIG. 15C is a perspective view of the strain relief and shield termination body shown in FIG. 15A and rotated to a 45 degree position.
Figure 15B:
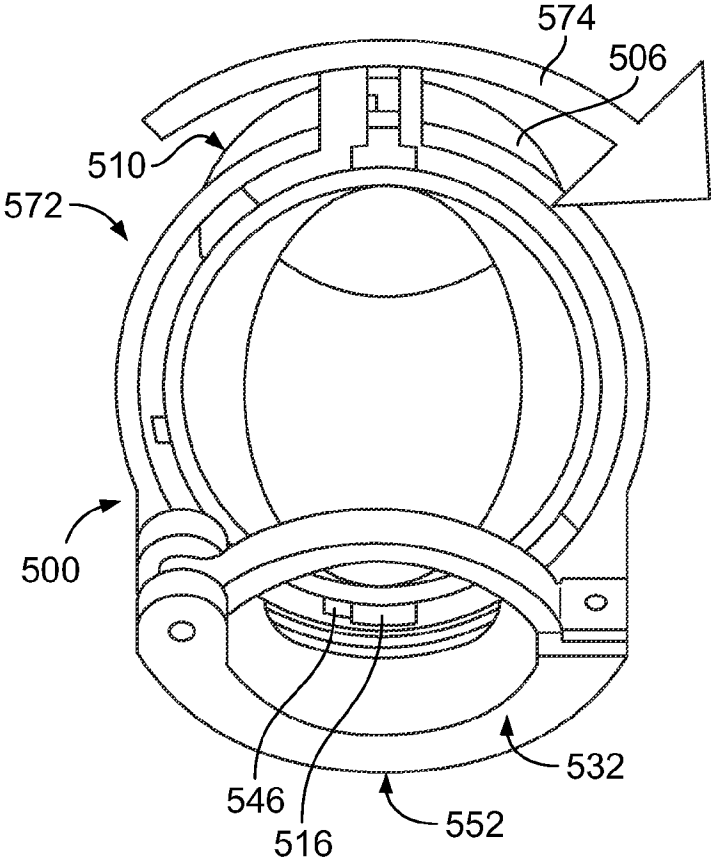
FIG. 15B is a perspective view of the strain relief and shield termination body shown in FIG. 15A and rotated to a 0 degree position.

FIG. 15B is a perspective view of the strain relief 500 rotated to a 0 degree position 572. The strain relief 500 is rotated in the direction of arrow 574. In the 0 degree position 572, the first tab 516 abuts the second protrusion 546. The second protrusion 546 prevents further rotation of the strain relief 500 in the direction of arrow 574. In the 0 degree position 572 the face 552 formed by the cable clamp end 532 of the strain relief 500 is oriented approximately 0 degrees with respect to the face 510 formed by the connector end 506 of the shield termination body 502.

The strain relief 500 may be rotated to any intermediate position between the second entry position 570 and the 0 degree position 572 so that the face 552 may be oriented with respect to the face 510 at intermittent angles. The lock 548 is secured to prevent rotation of the strain relief 500 with respect to the shield termination body 502. The lock 548 secures the strain relief 500 to the shield termination body 502 at the intermediate positions between the second entry position 570 and the 0 degree position 572.

FIG. 15C is a perspective view of the strain relief 500 rotated to a second 45 degree position 576. The strain relief 500 is rotated in the direction of arrow 578. In the second 45 degree position 576, the second tab 522 abuts the first protrusion 544. The first protrusion 544 prevents further rotation of the strain relief 500 in the direction of arrow 578. In the second 45 degree position 576, the face 552 formed by the cable clamp end 532 of the strain relief 500 is oriented approximately 45 degrees with respect to the face 510 formed by the connector end 506 of the shield termination body 502.

The strain relief 500 may be rotated to any intermediate position between the second entry position 570 and the second 45 degree position 576 so that the face 552 may be oriented with respect to the face 510 at intermittent angles. The lock 548 is secured to prevent rotation of the strain relief 500 with respect to the shield termination body 502. The lock 548 secures the strain relief 500 to the shield termination body 502 at the intermediate positions between the second entry position 570 and the second 45 degree position 576.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A rotationally configurable backshell to be joined to an electrical connector, the rotationally configurable backshell comprising:

a connector body having a connector interface and a shield interface, the connector interface configured to engage and form an electrical connection with the electrical connector;

a shield termination body having a connector end and a relief end; the connector end joined to the connector interface of the connector body, a face of the connector end oriented at an angle with respect to a face of the relief end, the shield termination body configured to shield a cable extending from the electrical connector; and a strain relief having a shield end and a cable clamp end; a face of the shield end oriented at an angle with respect to a face of the cable clamp end, the shield end rotatably joined to the relief end of the shield termination body, the shield end of the strain relief freely rotatable with respect to the relief end of the shield termination body so that the face of the cable clamp end of the strain relief is positionable at any angle from 0 to 90 degrees with respect to the face of the connector end of the shield termination body, the cable clamp end of the strain relief configured to secure the cable extending from the electrical connector.

2. The rotationally configurable backshell of claim 1, wherein the face of the connector end of the shield termination body is oriented at a 45 degree angle with respect to the face of the relief end of the shield termination body.

3. The rotationally configurable backshell of claim 1, wherein the face of the shield end of the strain relief is oriented at a 45 degree angle with respect to the face of the cable clamp end of the strain relief.

4. The rotationally configurable backshell of claim 1, wherein the relief end of the shield termination body includes protrusions and the shield end of the strain relief includes notches, the notches of the strain relief configured to receive the protrusions of the shield termination body to limit rotation of the strain relief with respect to the shield termination body.

5. The rotationally configurable backshell of claim 1, wherein the shield end of the strain relief includes a band that is rotatably engaged with a groove formed in the relief end of the shield termination body.

6. The rotationally configurable backshell of claim 1, wherein the strain relief includes a sealing tubing.

7. The rotationally configurable backshell of claim 1, wherein the connector interface includes teeth that engage the body of the electrical connector to prevent rotation of the backshell with respect to the electrical connector.

8. The rotationally configurable backshell of claim 1, further comprising a coupling nut to secure the connector interface to the body of the electrical connector.

9. The rotationally configurable backshell of claim 1 further comprising a reducer disc coupled between the shield termination body and the connector interface, the reducer disc configured to join connector interfaces having varying sizes to the shield termination body.

10. The rotationally configurable backshell of claim 1, further comprising a tool-less lock configured to secure the shield end of the strain relief to the relief end of the shield termination body.

11. The rotationally configurable backshell of claim 1, wherein the cable clamp end of the strain relief includes a saddle clamp to secure the cable extending from the connector.

12. The rotationally configurable backshell of claim 1 further comprising a tool-less lock configured to secure the cable clamp end of the strain relief around the cable.

13. A backshell for an electrical assembly comprising:

a shield termination body having a connector end and a relief end; the connector end configured to join to a cable end of an electrical connector, a face of the connector end oriented at an angle with respect to a face of the relief end; and a strain relief having a shield end and a cable clamp end; a face of the shield end oriented at an angle with respect to a face of the cable clamp end, the shield end rotatably coupled to the relief end of the shield termination body, the shield end of the strain relief freely rotatable with respect to the relief end of the shield termination body so that the face of the cable clamp end of the strain relief is positionable at any angle from 0 to 90 degrees with respect to the face of the connector end of the shield termination body.

14. The backshell of claim 13, wherein the face of the connector end of the shield termination body is oriented at a 45 degree angle with respect to the face of the relief end of the shield termination body.

15. The backshell of claim 13, wherein the face of the shield end of the strain relief is oriented at a 45 degree angle with respect to the face of the cable clamp end of the strain relief.

16. The backshell of claim 13, wherein the relief end of the shield termination body includes protrusions and the shield end of the strain relief includes notches, the protrusions of the shield termination body received within the notches of the strain relief to limit rotation of the strain relief with respect to the shield termination body.

17. The backshell of claim 13, wherein the shield end of the strain relief includes a flange having openings formed therein and the relief end of the shield termination body includes a tab that is configured to be received in the openings of the flange, the flange configured to engage the tab to secure the strain relief to the shield termination body.

18. The backshell of claim 13, wherein the relief end of the shield termination body includes a tab and the shield end of the strain relief includes a protrusion, the strain relief rotatable with respect to the shield termination body so that the tab engages the protrusion.

* * * * *